US012043964B2

(12) United States Patent
Buerger

(10) Patent No.: US 12,043,964 B2
(45) Date of Patent: Jul. 23, 2024

(54) METHOD OF TAMPING A TRACK IN THE AREA FOR A SWITCH

(71) Applicant: PLASSER & THEURER EXPORT VON BAHNBAUMASCHINEN GMBH, Vienna (AT)

(72) Inventor: Martin Buerger, Linz (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 868 days.

(21) Appl. No.: 17/058,228

(22) PCT Filed: Apr. 16, 2019

(86) PCT No.: PCT/EP2019/059729

§ 371 (c)(1),
(2) Date: Nov. 24, 2020

(87) PCT Pub. No.: WO2019/223939

PCT Pub. Date: Nov. 28, 2019

(65) Prior Publication Data

US 2021/0156094 A1 May 27, 2021

(30) Foreign Application Priority Data

May 24, 2018 (AT) ..... A 148/2018

(51) Int. Cl.
*E01B 27/16* (2006.01)
*E01B 35/00* (2006.01)

(52) U.S. Cl.
CPC ..... *E01B 27/16* (2013.01); *E01B 35/00* (2013.01); *E01B 2203/125* (2013.01)

(58) Field of Classification Search
CPC ..... E01B 27/16; E01B 27/17; E01B 35/00; E01B 2203/125
See application file for complete search history.

(56) References Cited

U.S. PATENT DOCUMENTS 4,905,604 A 3/1990 Theurer
4,986,189 A * 1/1991 Theurer ..... E01B 27/17 104/12

(Continued)

FOREIGN PATENT DOCUMENTS

DE 3904179 A1 2/1990
DE 3923733 A1 8/1990

(Continued)

*Primary Examiner* — Robert J McCarry, Jr.
(74) *Attorney, Agent, or Firm* — Laurence A. Greenberg; Werner H. Stemer; Ralph E. Locher

(57) ABSTRACT

A method for tamping a track in the region of a switch uses a tamping machine mobile on a track. In a first working pass a first branch is brought into desired position and tamped, thereafter the tamping machine travels backward to a point before a branching point, and in a second working pass a second branch is brought into desired position and tamped. During the backward travel, an actual position of the second branch is recorded by a sensor arrangement, particularly relative to the position of the first branch, and correction values for the position of the second branch are calculated based on the recorded actual position. Therefore, the backward travel, which is necessary anyway, is used to determine the position of the second branch, which position changes in the course of the first working pass. A tamping machine for carrying out the method is also provided.

7 Claims, 2 Drawing Sheets

(56) References Cited

U.S. PATENT DOCUMENTS

| | | | | |
|---|---|---|---|---|
| 6,453,822 | B2 * | 9/2002 | Theurer | E01B 35/04<br>104/7.2 |
| 10,550,525 | B2 | 2/2020 | Lichtberger | |

FOREIGN PATENT DOCUMENTS

| | | | |
|---|---|---|---|
| EP | 1143069 | A1 | 10/2001 |
| EP | 3009564 | A1 | 4/2016 |
| WO | 2016081971 | A1 | 6/2016 |

* cited by examiner

METHOD OF TAMPING A TRACK IN THE AREA FOR A SWITCH

BACKGROUND OF THE INVENTION

Field of the Invention

The invention relates to a method of tamping a track in the area of a switch by means of a tamping machine mobile on a track, wherein in a first working pass a first branch is brought into a target position and tamped, wherein subsequently the tamping machine travels rearward to a location ahead of a branch-off point, and wherein in a second working pass a second branch is brought into a target position and tamped. The invention additionally relates to a tamping machine for implementing the method.

DESCRIPTION OF THE RELATED ART

On-track tamping machines for the tamping of track lines and switch sections have long been known. A machine of this kind is disclosed in EP 1 143 069 A1, for example. This machine includes a lifting/lining unit for levelling and lining a trunk line (main track) and an auxiliary lifting device for lifting a branch track (branch line of a switch) branching off the main line. In this, in a first working pass while travelling on the main track, the branch track is also lifted in the effective range of the auxiliary lifting device, wherein a common measuring system ensures a controlled lifting of the switch.

In this manner, the actual position of the branch track in the area of the switch is changed, and a measurement optionally carried out beforehand can no longer be used to deliver specifications for lifting or lining and tamping of the onward-leading branch track. Therefore, prior to a second working pass during which the branch track is travelled upon and tamped, a manual survey of the result of the first working pass must take place according to the prior art.

SUMMARY OF THE INVENTION

The objects of the invention are to provide improvements over the prior art for a method and a tamping machine of the type mentioned at the beginning.

According to the invention, these objects are achieved by way of the combination of features of the independent claims. Advantageous further developments of the invention become apparent from the dependent claims.

In this, during the rearward travel, an actual position of the second branch is recorded by means of a sensor arrangement, in particular with respect to the position of the first branch, and—based on this recorded actual position—correction values for the position of the second branch are calculated. The rearward travel, which is necessary in any case, is used in this manner to determine the position of the second branch changed in the course of the first working pass. Thus, a complex manual intermediate measurement prior to being able to begin the second working pass is omitted. The term first branch here refers to that track which is lifted and lined during the first working pass, irrespective of whether it is a main track or a branch track.

Advantageously, the recording of the actual position of the second branch takes place in a recording area extending beyond a switch end point. In this, the switch end point is usually defined as the last continuous common sleeper of main track and branch track. Thus, during the rearward travel, the entire area is recorded in which—after the first working pass—the second branch is in a new position.

A further improvement provides that a reference plane defined by the position of the first branch is specified, and that correction values for the position of the second branch are calculated as deviations with regard to said reference plane. In this manner, the correction of the second branch carried out in the second working pass takes place in relation to the already tamped first branch. Alternatively, the correction of the second branch can also take place in relation to another prescribed target position.

Advantageously, for recording the actual position, surface contours of the two branches are recorded by means of the sensor arrangement. Thus, particularly by way of the surface contours of the rails, the actual positions of the track axes can be computed in a simple manner, and the correction values can be specified in further sequence.

In this, it is favourable if the surface contours are recorded as a point cloud and evaluated by means of a computer unit. For processing corresponding data, efficient algorithms are known which enable a quick and precise identification of the track axes. In addition, filtering methods can be used to reduce the amount of data. For example, only the surface points of the rails are processed further. With known algorithms, imaging errors, distortion errors or other recording errors are also reliably recognized and eliminated.

A further development of the method provides that the calculated correction values are transmitted to a so-called guiding computer of the tamping machine. The guiding computer is a calculator unit for carrying out a track position correction, wherein the tamping machine is guided according to a pre-set target geometry of the track. During this, the guiding computer prescribes the corresponding parameters to the control devices of the tamping machine.

According to the invention, a sensor device is arranged on a tamping machine for carrying out one of the above-mentioned methods, the sensor device being designed for recording the actual position of the second branch during a rearward travel. The sensor device thus comprises sensors which cover a corresponding recording area at both sides of the tamping machine.

In this, it is advantageous if the sensor device includes a laser scanner. Such laser scanners deliver sufficiently exact data for a precise track position correction and cover a wide area of the surroundings of the tamping machine.

Additionally, it is advantageous if the sensor device includes a light section sensor. With this, a target-oriented recording of the course of the rails can be carried out with high precision.

Favourably, the tamping machine comprises a that a computer unit which is designed for calculating the correction values for the position of the branch track on the basis of a recorded point cloud. The corresponding track position correction then takes place by means of these correction values.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 1:
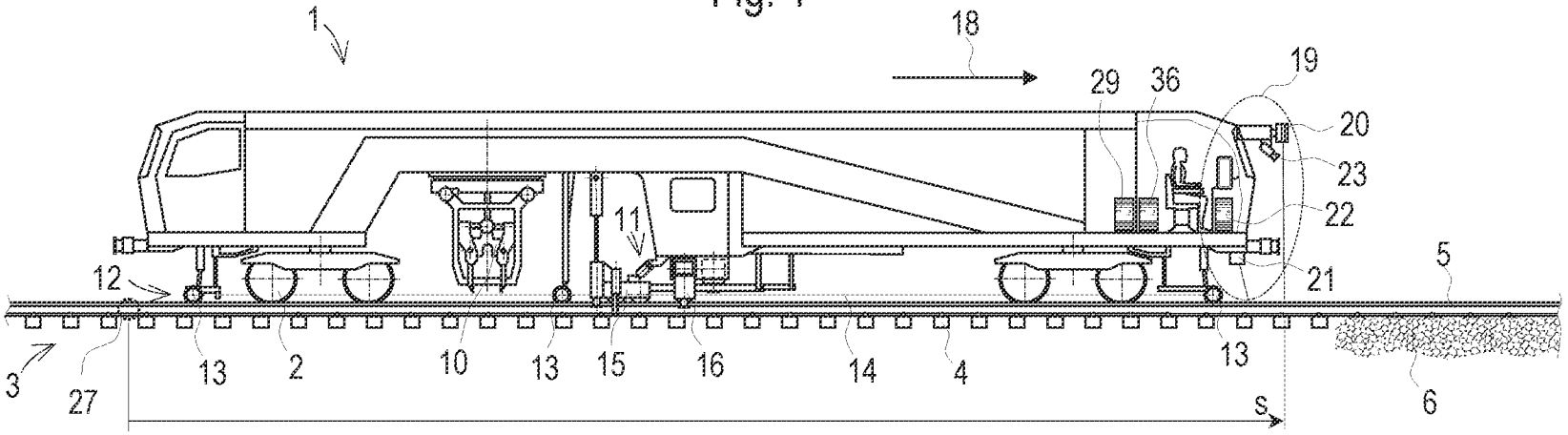
FIG. 1 a tamping machine in a side view
Figure 2:
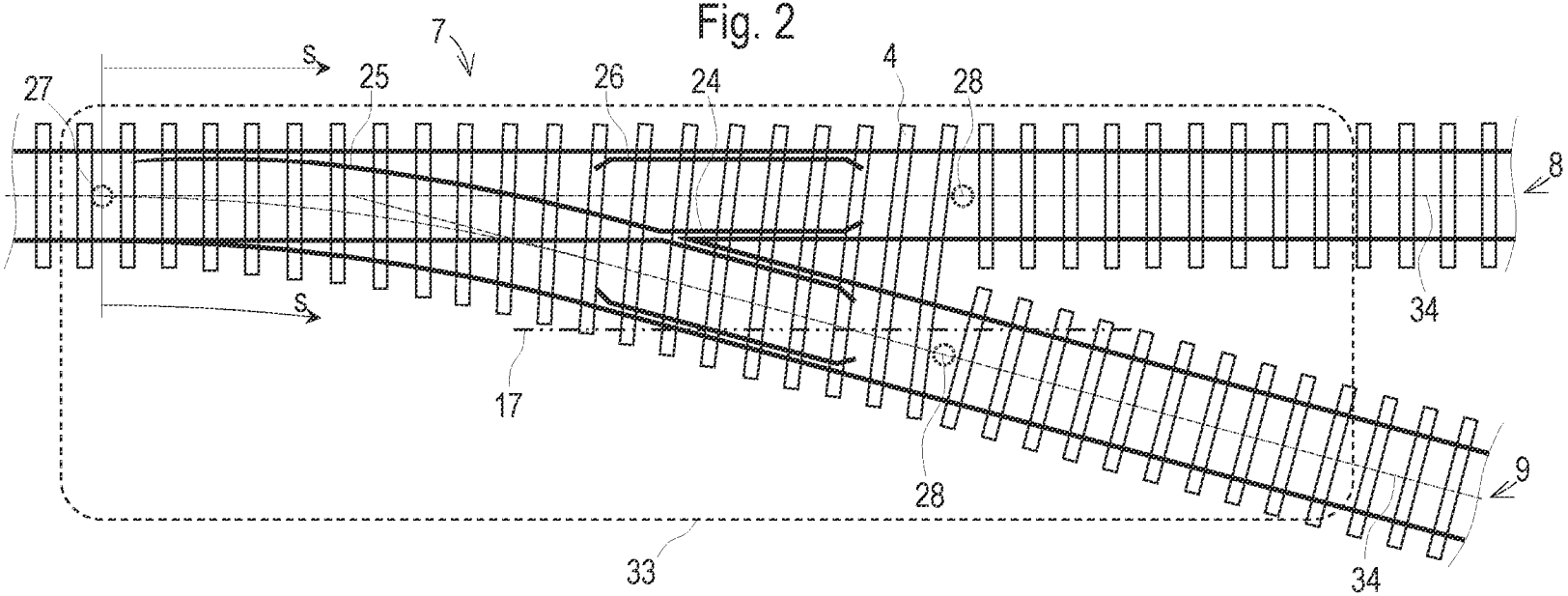
FIG. 2 a switch section in a top view

The tamping machine 1 shown in FIG. 1 is mobile on a track 3 by means of powered on-track undercarriages 2. The track 3 comprises sleepers 4 which, together with rails 5 fastened thereon, form a track grid supported in a ballast bed 6. A switch 7 forks the track 3 into two branches 8, 9. In the case of a simple switch according to FIG. 2, these are a main track and a branch track. In addition, one distinguishes curved switches, double switches and slip switches. For position correction of such switch sections, special methods and special switch tamping machines are used.

For performing a track position correction, the tamping machine 1 comprises a tamping unit 10, a lifting device 11 and a measuring device 12 with measuring trolleys 13 and measuring chords 14. The measuring chords 14 are, for example, tensioned steel chords or optical chords which extend between light-emitting elements and light sensors. In addition to a main lifting device 15, the lifting device 11 comprises two laterally extensible auxiliary lifting devices 16. By means of the respective auxiliary lifting device 16, a branching-off branch 9 is lifted and lined until a maximum lateral treatment limit line 17 is reached.

Arranged at the forward front side, with regard to the working direction 18, is a sensor arrangement 19. The latter comprises a laser scanner 20 and/or a light section sensor 21 as well as an evaluation device 22 for calculating a point cloud. Additional information can be recorded by means of a camera 23. For example, the point cloud can be augmented with color information.

A to-be-treated switch section with a simple switch 7 comprises a switch diamond 24, switch blades 25 and check rails 26 as well as a switch starting point 27 and two switch end points 28. The main track and the branch track have continuous sleepers 4 up to the switch end points 28, so that a lifting and lining of the one branch inevitably also effects the other branch.

During a track position correction in the switch section, initially the first branch 8 is brought into a prescribed target position in a first working pass. During this, the lifting device 11 lifts and lines the track grid, wherein the current track position is recorded continuously by means of the measuring device 12 and compared to the prescribed target position. Upon reaching the target position, the track grid is stabilized in its position by consolidation of the ballast bed 6 by means of the tamping unit 10.

During this, the tamping machine 1 is guided by a so-called guiding computer 29 according to a known target geometry of the track 3. Alternatively, it is also possible to guide the tamping machine 1 with unknown geometry. To that end, the tamping machine 1 performs a measuring run prior to the track position correction and, by means of an electronic versine compensation, the target position is determined with corresponding correction values from the surveyed actual position of the track 3.

According to the invention, the sensor arrangement 19 is designed in such a way that, during rearward travel of the tamping machine 1 up to a branching-off point, the actual position of the second branch 9 is recorded. Since the tamping machine 1 travels on the first branch 8 during this, the latter forms the reference base for the recording of the actual position of the second branch 9. From this, correction values 30, 31, 32 for the position of the second branch 9 are calculated. During this, the position recording of the second branch 9 takes place in a recording area 33 in which the actual position of the second branch 9 has been changed during the first working pass. This recording area 33 extends at least to beyond the treatment limit line 17 and advantageously beyond the switch end point 28. The greater recording area 33 permits a reliable recording of the entire section of the second branch 9 changed during the first working pass.

Advantageously, the laser scanner 20 is arranged centrally in the upper region at the forward front side of the tamping machine 1, so that a wide area is recorded at both sides of the tamping machine 1. A laser beam rotating about a longitudinal axis of the tamping machine 1 traces the surface of the track 3 and its surroundings, wherein a distance to the illuminated surface point is measured at timed intervals. In this manner, a grid-like recording of the surface results. In particular, a transverse profile of the track including the surroundings is surveyed during each rotation of the laser beam, wherein a helix-shaped succession of measuring points takes place during a forward- or backward movement. The sum of all measuring points produces a point cloud of the track and its surroundings.

Alternatively, or additionally, light section sensors 21 are arranged above each rail 21. These also emit laser beams and measure the distance to an illuminated surface point by means of a detector according to the principle of triangulation. Here also, the result is a point cloud of the track and its surroundings. If several sensors 20, 21, 23 are used simultaneously, a merging of all measuring data takes place by way of sensor fusion by means of the evaluation device 22. The resulting point cloud contains precise position information and, optionally, color information on the surface points of the track 3 and its surroundings.

Figure 3:
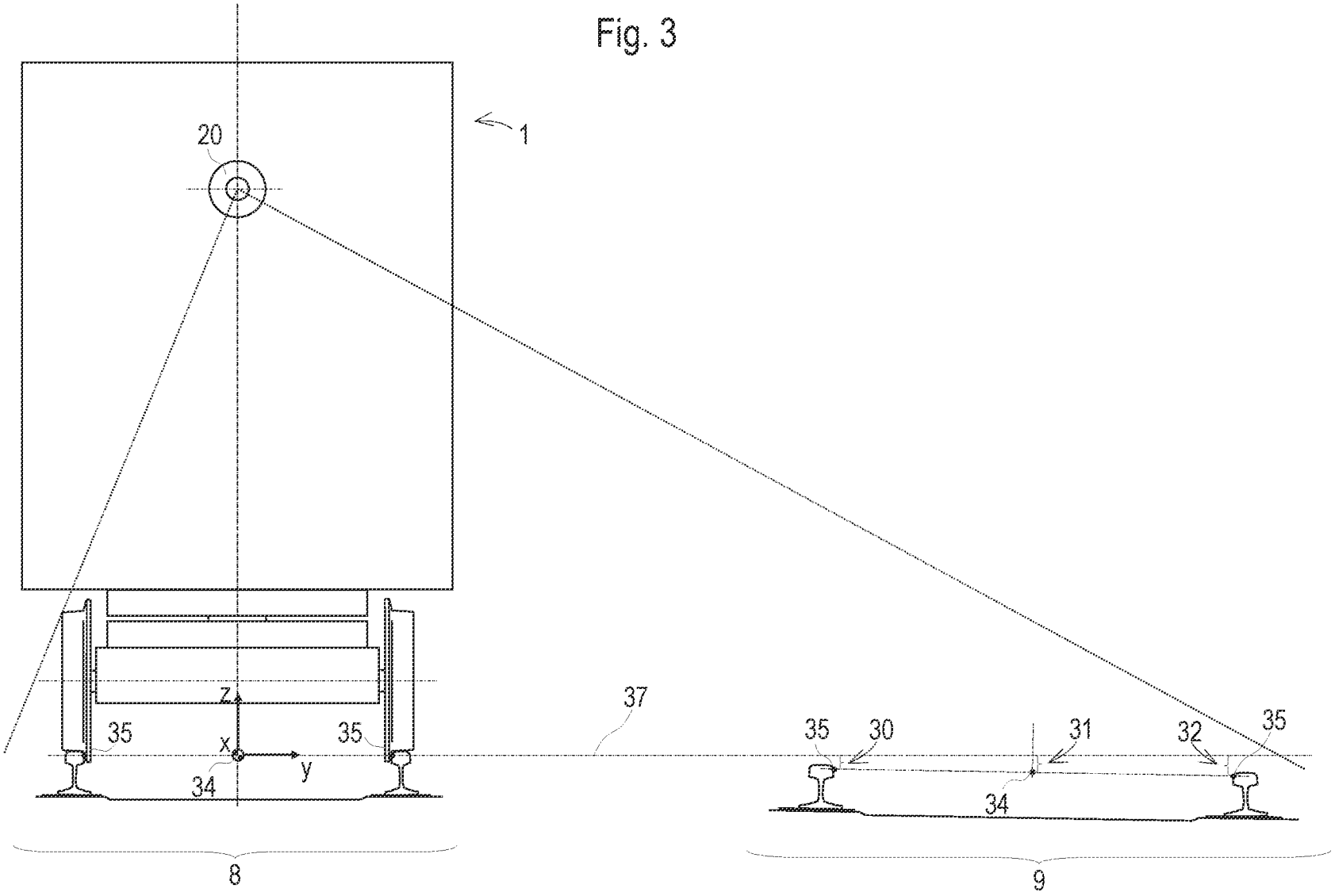
FIG. 3 a cross-section of a main track and a branch track

Advantageously, as a common reference system, an orthogonal coordinate system x, y, z following the track course is specified (FIG. 3). In this, the coordinate origin advantageously lies on the so-called track axis 34 (track center) which extends at the midpoint of the track gauge between the two rails 5. The x-axis of the coordinate system points in the direction of travel, the y-axis points in the transverse direction of the track. The values of the z-axis then indicate vertical deviations of the recorded surface points with respect to the x-y plane.

In addition to the recording of the position with respect to the coordinate system, the path distance s to a reference point defined along the track is recorded continuously, for example by means of an odometer (kilometer mileage). Alternatively, or additionally, a GNSS device for determining the current measuring position can be used. With this, the y-coordinates and z-coordinates relevant for the track position are assigned to an exact location on the track 3. The same applies if a stationary or inertial coordinate system is specified as common reference system.

Usually, the recorded point cloud initially refers to another coordinate system which is moved along with the sensor device 19, for example. For a coordinate transformation, first the position of the track axis 34 is calculated from coordinates of the surface points 35 at the inner edges of the rails 5 of the track 3 travelled upon. These surface points 35 are determined by means of known methods of pattern recognition. In further sequence, the coordinates of all points, or a previously filtered point set of the point cloud, are transformed to the coordinate system x, y, z which follows the track course. Preferably, the transformation process takes place in a calculating unit 36 of the tamping machine 1 in which a software for pattern recognition and coordinate transformation is installed.

In this manner, during the rearward travel of the tamping machine 1 after the first working pass has been performed, the surface points of the second branch 9 are recorded with respect to the first branch 8. In a next method step, the software set up in the computing unit 36 determines the coordinates of the surface points 35 at the inner edges of the rails 5 of the second branch 9 as well as of the corresponding track axis 34. This takes place by means of pattern recognition and, optionally, by interpolation if no recorded surface point can be assigned to the respective rail inner edge.

On the basis of these data, the computer unit 36 calculates correction values 30, 31, 32 for the second working pass for the two rails 5 or the track axis 34 in dependence on the path distance s along the second branch 9. In particular, all relevant points of the point cloud along the two branches 8, 9 are used for the calculation of the correction values 30, 31, 32. In this, it is irrelevant that, during the measurement by means of the laser scanner 20, a transverse profile of the track 3 recorded at the first branch 8 results in a slanting profile of the track 3 for the second branch 9. As soon as all scanned surface profiles are assembled into the spatial point cloud, the entire actual geometry of the two recorded branches 8, 9 in a common reference system is known.

Usually, the second branch 9 is lifted to the vertical level of the already treated first branch 8. The correction values can be determined easily because the first branch is prescribed as reference system for the recording of the point cloud. In the simplest case, a reference plane 37 specified by the position of the first branch 8 is determined, and deviations from this reference plane 37 are calculated as correction values 30, 31, 32. In other words, the correction values 30, 31, 32 correspond to the recorded deviations in the direction of the z-axis. If the prescribed target position of the first branch 8 has not been reached in the first working pass, this not-reached target position is used as reference system for the calculation of the correction values 30, 31, 32. Thus, no error propagation takes place.

If, in exceptional cases, separate longitudinal inclinations are prescribed for the second branch 9, a correspondingly adapted calculation of the correction values 30, 31, 32 takes place. As soon as the tamping machine 1 reaches an area on the second branch 9 which has remained uninfluenced by the first working pass, the correction work is continued as usual. This transition can be recognized by the fact that the actual position of the second branch 9 recorded during the rearward travel coincides with a previously surveyed actual position at the corresponding track position.

After transferring the correction values 30, 31, 32 to the guiding computer 29, the latter calculates the working- and adjustment parameters which are required for guiding the tamping machine 1. Alternatively, the actual position of the second branch 9 can be transmitted to the guiding computer 29, in particular as a progression of versines. The calculation of the correction values 30, 31, 32 then takes place by means of the guiding computer 29 by comparison to a stored target position of the corresponding track section. During the working passes, the measuring device 12 is employed in order to ensure that the prescribed corrections are achieved.

The invention claimed is:

1. A method for tamping a track in a region of a switch by using a tamping machine mobile on the track, the method comprising:

in a first working pass, bringing a first branch of the track into a target position and tamping the first branch of the track;

subsequently moving the tamping machine rearward to a location ahead of a branch-off point of the track;

in a second working pass, bringing a second branch of the track into a target position and tamping the second branch of the track;

during the rearward movement of the tamping machine, using a sensor arrangement to record an actual position of the second branch of the track; and calculating correction values for the position of the second branch of the track based on the recorded actual position.

2. The method according to claim 1, which further comprises carrying out the recording of the actual position of the second branch of the track relative to a position of the first branch of the track.

3. The method according to claim 1, which further comprises carrying out the recording of the actual position of the second branch of the track in a recording area extending beyond a switch end point.

4. The method according to claim 1, which further comprises specifying a reference plane defined by the position of the first branch of the track, and calculating the correction values for the position of the second branch of the track as deviations relative to the reference plane.

5. The method according to claim 1, which further comprises using the sensor arrangement to record surface contours of the first and second branches of the track.

6. The method according to claim 5, which further comprises recording the surface contours as a point cloud, and using a computer unit to evaluate the surface contours.

7. The method according to claim 1, which further comprises transmitting the calculated correction values to a guiding computer of the tamping machine.

* * * * *